United States Patent [19]

Crystal

[11] 4,012,254

[45] Mar. 15, 1977

[54] NOVEL PHOTOCONDUCTIVE WATERLESS LITHOGRAPHIC PRINTING MASTERS, AND PROCESS OF PREPARATION

[75] Inventor: Richard G. Crystal, Dallas, Tex.

[73] Assignee: Xerox Corporation, Stamford, Conn.

[22] Filed: Apr. 28, 1975

[21] Appl. No.: 572,682

[52] U.S. Cl. ..... 96/1.5; 96/33; 427/409; 101/463

[51] Int. Cl.[2] ..... G03G 5/04

[58] Field of Search ..... 96/1 S, 33, 1 R; 101/463; 427/409

[56] References Cited

UNITED STATES PATENTS

| | | | |
|---|---|---|---|
| 3,547,627 | 12/1970 | Amidon et al. | 96/1 R |
| 3,578,444 | 5/1971 | Silver | 96/1 R |
| 3,671,232 | 6/1972 | Kumins | 96/1 R |
| 3,907,562 | 9/1975 | Crystal | 96/1 R |

*Primary Examiner*—John D. Welsh
*Attorney, Agent, or Firm*—James J. Ralabate; James P. O'Sullivan; Donald M. MacKay

[57] ABSTRACT

Photoconductive waterless lithographic printing masters are provided having particle-to-particle contact of photoconductive material by placing a heterogeneous copolymer having an abhesive species and an imaging material adhesive species, in a solvent in which at least one of said species can be preferentially dissolved, preferentially dissolving one of said species and forming a suspension of photoconductive material in said soluble species, and coating the suspension on a suitable master substrate, allowing the solvent to evaporate, imaging the material with an ink accepting particulate imaging material in image configuration, and fusing the particulate imaging material to the coated master substrate while preferably effecting a phase inversion between the two species of the heterogeneous copolymer.

12 Claims, No Drawings

NOVEL PHOTOCONDUCTIVE WATERLESS LITHOGRAPHIC PRINTING MASTERS, AND PROCESS OF PREPARATION

BACKGROUND OF THE INVENTION

This invention relates to a novel method for preparing photoconductive waterless lithographic printing masters of the planographic type.

In conventional lithography, an aqueous fountain solution is employed to prevent the ink from wetting the non-imaged areas of the planographic plate. It has recently been discovered that the requirement for a fountain solution can be obviated by employing a planographic plate having a silicone, i.e., organopolysiloxane, elastomeric layer. Because the silicone is not wetted by the printing ink, no fountain solution is required. While the use of silicone elastomers as a printing surface has obviated the requirement for a fountain solution, it has been found that finely divided particulate material commonly referred to in the trade as "toner", is not easily attached to the silicone. Thus, the abhesive or non-adhesive property of the silicone which renders it useful for rejecting lithographic inks, also causes it to reject other materials such as toner. Accordingly, it has been difficult to prepare a printing master in which the toner could be sufficiently attached to the silicone such that it would not become removed after a short run on a printing press. It is this problem to which this invention is directed.

BRIEF DESCRIPTION OF THE INVENTION

It is now been discovered that a novel waterless lithographic printing master can be prepared with photoconductive particles dispersed therein to simplify plate development and which can be imaged with a particulate imaging material and the imaging material firmly bonded thereto despite the abhesive nature of the surface printing layer. More particularly, the master is prepared by placing a heterogeneous copolymer (to include mixtures or blends with homopolymers) containing an abhesive species and an imaging material adhesive species in a solvent in which at least one of said species can be preferentially dissolved. By preferential it is meant that the solvent preferably dissolves only one component at a particular concentration, thermal conditions, etc. so that one component has a higher solubility than the other. The nonsoluble species form micelles in solution as evidenced by a cloudiness or observable Tyndall effects in the solution. A finely divided photoconductive pigment is then dispersed in the solution and the resultant suspension coated on a suitable conductive master substrate and the solvent allowed to evaporate. The soluble component forms the matrix in which the pigment is dispersed and by controlling the stoichiometry, the photoconductive pigment particles form a network of particle-to-particle contact throughout the member. Preferably, the materials are selected such that the nonabhesive species is forced to form the matrix even when it is the stoichiometric minor component. The coated substrate is then imaged with a particulate imaging material which is ink receptive such as xerographic toner and the imaging material fused to the nonabhesive species, and then allowing them to harden together. In a preferred embodiment, the nonabhesive species are softened sufficiently to cause a phase inversion in which the abhesive phase then forms the matrix or migrates to the surface and the nonabhesive pigment phase forms the dispersed phase. Background areas are thus rendered ink abhesive while toned areas remain ink receptive. The toner, however, is anchored to the plate by means of the nonabhesive component.

DETAILED DESCRIPTION OF THE INVENTION

Typical materials which include the types of master materials as well as detailed instructions for preparing the masters are herein discussed in detail.

Substrates which can be employed for the printing master are those conductive, self-supporting materials to which the copolymer can adhere and be compatible therewith as well as possess sufficient heat and mechanical stability to permit use under widely varying conditions. Exemplary of suitable substrates are metals such as aluminum; metallized plastics such as aluminized polyesters, polycarbonates, polysulfones and polyimides.

The surface heterogeneous copolymer layer is formed of abhesive polysiloxane groups which can be cured or coalesced to an ink releasable elastomeric condition, and organic thermoplastic blocks which can be alternately softened such as by heat and/or solvent, and hardened so as to bond the particulate imaging material thereto. The siloxane blocks can be those having only alkyl containing groups in the polymer chain such as polydimethylsiloxane or polydiethylsiloxane; gums having both alkyl and phenyl containing groups in the polymer chain as well as gums having both alkyl and vinyl groups, alkyl and fluorine groups or alkyl, phenyl and vinyl groups in the polymer chain. The organic materials employed to form the nonabhesive blocks in the copolymer are conventional thermoplastic monomers such as styrene, alpha-methylstyrene, styrene/n-butyl methacrylate, polycarbonate, vinyl chloride, polyesters, polyamides, polyethers and styrene-butadiene. Block, graft and polymer blends of homopolymers with block or graft copolymers can be employed. With the blends curing is preferably accomplished during the image fusing operation in order to maximize film strength.

While not limiting, preferred proportions for the copolymer comprise a ratio by weight of between about 50-90 parts polysiloxane and 10 to 50 parts of the thermoplastic blocks. A most preferred ratio is from about 70 to 90 parts polysiloxane groups. A catalyst which will preferentially cure the siloxane blocks may be employed. Typical catalysts include the peroxides such as benzoyl peroxide and the like, the particular catalyst depending upon the silicone employed. Copolymers of the above type, can be prepared in the manner illustrated by the procedure for preparation of an organopolysiloxane polystyrene block copolymer as described in Macromolecules, volume 3, January-February 1970, pages 1–4, which is herein incorporated by reference in its entirety. Also, blends of the copolymer and an abhesive homopolymer can be employed as exemplified by Example II herein. Suitable catalysts are provided by the manufacturers of the silicone gums.

Conventional organic and inorganic photoconductors can be employed. Typical inorganic crystalline photoconductors include cadmium sulfide, cadmium sulfoselenide, cadmium selenide, zinc sulfide, zinc oxide and mixtures thereof. Typical inorganic amorphous photoconductive materials include selenium and selenium alloys such as selenium-tellurium and selenium-arsenic. Selenium may also be used in its hexagonal crystalline form, commonly referred to as trigonal selenium. Typical organic photoconductors include phthalocyanine pigments such as the X-form of metal-free phthalocyanine described in U.S. Pat. No. 3,357,989 to Byrne et al, and metal phthalocyanine pigments, such as copper phthalocyanine. Other typical organic photoconductors include polyvinyl carbazole, trinitrofluorenone and photoinjecting pigments such as benzimidazole pigments, perylene pigments, quinacridone pigments, indigoid pigments and polynuclear quinones. Alternatively, the photoconductor can be dispersed in a binder of one of the aforesaid polymeric substrate materials to serve as the ink-accepting substrate.

The copolymer can be coated on the substrate by conventional means such as draw bar coating, in a suitable solvent and the solvent allowed to evaporate. Typical solvents which will dissolve polysiloxanes are bromobenzene, toluene, benzene, xylene, hexane, heptane, octane and the like. Typical solvents that will preferentially dissolve the organic thermoplastic blocks are acetone and isopropyl alcohol. If desired, the siloxane blocks can then be preferentially cured, such as by heat, to activate a catalyst to a crosslink density of between about 0.5 and about 5 percent. The amount of crosslinking will depend upon the particular polymer employed but preferably the siloxane blocks are coalesced or cured sufficiently such that the copolymer is ink releasing but not so much that thermoplastic blocks become cured so that the particulate imaging material cannot be physically bonded thereto; or the nonimaged areas are rendered ink accepting.

The master can be imaged by conventional means such as electrostatographic imaging directly on the master and developed thereon. The particulate imaging material can be any conventional ink accepting material commonly referred to in the art as toner. Typical toners include thermoplastic polymers such as polyacrylates, polyesters, and polymers of styrene. Typical polymers of styrene include polystyrene, styrene/n-butyl methacrylate copolymer and styrene-butadiene copolymer. Other materials which can be employed include: polypropylene, ethylene-vinyl acetate copolymers, polyamides, polyimides, phenoxies, polyesters and vinyls. Although it is preferred, the imaging material need not be thermoplastic. Typical nonthermoplastic materials are carbon black, and inorganic salts, which can also be employed. After the master is imaged, the particulate material can be fixed by heating the master to soften the thermoplastic blocks and then cooling or allowing the blocks to cool so as to harden and bond the particulate imaging material thereto.

The imaged printing master can then be employed on conventional planographic printing equipment by direct or offset means with the dampening system removed to provide good quality prints over an extended period of operation with conventional inks of the oleophilic, glycol or rubber based type. If desired, the master can be reimaged by removing the particulate imaging material with a suitable solvent and the thermoplastic blocks softened to deposit a new imaging material.

The following examples will serve to illustrate the invention and embodiments thereof. All parts and percentages in said examples and elsewhere in the specification and claims are by weight unless otherwise specified.

EXAMPLE I

A 70% polydimethylsiloxane (PDMS) — 30% polystyrene (PS) $(ABA)_n$ block copolymer wherein A is styrene and B is silicone obtained from Dow Corning Company, was dissolved in bromobenzene (5 gr. in 200cc). The solution was then vacuum distilled to obtain an approximately 10% solids turbid solution (50cc). Previous studies had indicated that the PDMS phase was insoluble at such concentrations and accordingly formed micelles. Cadmium sulfoselenide pigment was then added (4 gms. pigment in 10 cc) and the suspension was immediately knife coated on a ball grained aluminum substrate. After overnight drying at ambient temperature, the member was taped to an aluminum sheet and charged negatively in a Xerox model D processor and then imagewise toned with Xerox 2400 Dry Ink comprising styrene/n-butyl methacrylate with a reversal carrier. The member was heat fused in the processor and cooled to room temperature. Toner could not be removed with the application and removal of Scotch tape. The plate was then hand inked with Pope and Grey 2447 lithographic ink and the resultant copy was then transferred to Xerox Grade 1024 paper. Copies of excellent contrast were obtained.

EXAMPLE II

The general procedure of Example I is repeated but for the exception that the block copolymer is mixed with 5 grams of Dow Corning Silastic 740 polydimethylsiloxane gum and 0.1 gram of 2,4-dichlorobenzoyl peroxide in an additional 200cc of solvent. Similar results are obtained.

EXAMPLE III

The general procedure of Example I is repeated but for the exception that the block copolymer is mixed with 5 grams of Union Carbide Y-3557 polydimethylsiloxane gum in an additional 200cc of solvent.

EXAMPLE IV

The general procedure of Example I is repeated but for the exception that cadmium selenide is substituted for the cadmium sulfoselenide pigment.

Having described in the present invention with reference to these specific embodiments, it is to be understood that numerous variations can be made without departing from the spirit of the invention and it is intended to include such reasonable variations and equivalents within the scope.

What is claimed is:

1. A process for preparing a nonimaged photoconductive waterless lithographic printing master comprising providing a heterogeneous copolymer containing an abhesive species of polysiloxane groups and an imaging material adhesive species of organic thermoplastic groups, providing a solvent which will preferentially dissolve one of said species, placing said copolymer in said solvent wherein the nonsoluble species forms micelles, providing a photoconductive pigment and dispersing said pigment in the resultant solution, providing a suitable master substrate and coating the resultant suspension on said master substrate, and allowing the solvent to evaporate whereby the soluble species forms the matrix in which the pigment is dispersed.

2. The process of claim 1 wherein the abhesive species comprise the major proportion of the block copolymer.

3. The process of claim 1 wherein the abhesive species constitutes from about 70% to about 90% by weight of the block copolymer.

4. The process of claim 1 wherein the solvent preferentially dissolves the adhesive species.

5. The process of claim 1 wherein the abhesive species comprises a polysiloxane.

6. The process of claim 1 wherein the abhesive species is polydimethylsiloxane.

7. The process of claim 1 wherein the photoconductive pigment is employed in an amount sufficient to form a network of particle to particle contact.

8. The process of claim 1 wherein the master is heated above the glass transition temperature or melting point of the adhesive component to cause a phase inversion between the adhesive and abhesive species such that the abhesive species resides at the surface of the plate in non-image areas so as to increase the abhesive nature of the surface of the printing master.

9. The process of claim 1 wherein the toner wettable species is polystyrene.

10. The process of claim 1 wherein the preferential solvent is bromobenzene.

11. A process for preparing a photoconductive waterless lithographic printing master comprising providing a heterogeneous copolymer containing an abhesive species of polysiloxane groups and an imaging material adhesive species of organic thermoplastic groups, providing a solvent which will preferentially dissolve one of said species, placing said copolymer in said solvent wherein the nonsoluble species forms micelles, providing a photoconductive pigment and dispersing said pigment in the resultant solution, providing a suitable master substrate and coating the resultant suspension on said master substrate, and allowing the solvent to evaporate whereby the soluble species forms the matrix in which the pigment is dispersed, imaging the coated substrate by providing and depositing an ink accepting particulate imaging material in image configuration and fusing the particulate imaging material to the coated substrate.

12. A photoconductive nonimaged waterless lithographic printing master comprising:

a. a suitable master substrate, and b. a heterogenous copolymer adhered to said substrate comprising an abhesive species formed of abhesive polysiloxane groups which can be cured or coalesced to an ink releasable elastomeric condition and an imaging material adhesive species formed of organic thermoplastic blocks which can be alternately softened such as by heat and/or solvent, and hardened so as to bond a particulate imaging material thereto, said adhesive species containing an activating amount of photoconductive particles dispersed therein.

* * * * *